US007389567B2

(12) United States Patent
Rogers et al.

(10) Patent No.: US 7,389,567 B2
(45) Date of Patent: Jun. 24, 2008

(54) REMOVABLE HAT ACCESSORY

(75) Inventors: James R. Rogers, Rancho Cucamonga, CA (US); Sinclair Bishop, Huntington Beach, CA (US); Jason Wood, Mission Viejo, CA (US)

(73) Assignee: Namkung Promotions Inc., Costa Mesa, CA (US)

( * ) Notice: Subject to any disclaimer, the term of this patent is extended or adjusted under 35 U.S.C. 154(b) by 187 days.

(21) Appl. No.: 11/145,882

(22) Filed: Jun. 6, 2005

(65) Prior Publication Data

US 2006/0010557 A1 Jan. 19, 2006

Related U.S. Application Data

(63) Continuation-in-part of application No. 10/645,368, filed on Aug. 21, 2003, now Pat. No. 7,350,274.

(51) Int. Cl.
*A45F 5/00* (2006.01)
*A44B 1/00* (2006.01)

(52) U.S. Cl. ..... 24/113 R; 24/3.1; 24/3.12

(58) Field of Classification Search ..... 24/3.1, 24/3.12, 90.1, 113 MP, 113 R, 41.1, 42, 43, 24/46, 47, 48, 56–60, 66.1–66.7; 2/209.13, 2/209.14

See application file for complete search history.

(56) References Cited

U.S. PATENT DOCUMENTS

| | | | | | |
|---|---|---|---|---|---|
| 76,746 | A | * | 4/1868 | Gould | 24/113 R |
| 345,934 | A | * | 7/1886 | Thal | 24/56 |
| 644,894 | A | * | 3/1900 | Carlin | 24/43 |
| 737,878 | A | * | 9/1903 | Specht | 24/42 |
| 2,490,383 | A | * | 12/1949 | Stafford | 24/104 |
| 2,577,723 | A | * | 12/1951 | Groh | 24/113 R |
| 2,595,672 | A | * | 5/1952 | Greenwood | 24/113 MP |
| 2,611,902 | A | | 9/1952 | Rockmore | |
| 2,751,654 | A | * | 6/1956 | Armbruster | 24/113 MP |
| 3,077,051 | A | | 2/1963 | Quinones, Jr. | |
| 3,106,184 | A | | 10/1963 | Shea | |
| 3,316,601 | A | * | 5/1967 | Ryan | 24/113 R |
| 3,343,230 | A | * | 9/1967 | Darvie | 24/113 R |
| 3,353,231 | A | * | 11/1967 | Levine | 24/113 R |
| 3,543,354 | A | * | 12/1970 | Schuchman, Sr. et al. | 24/102 PL |
| 4,528,726 | A | * | 7/1985 | Kurashima | 24/102 SL |
| 4,639,983 | A | * | 2/1987 | Fukuroi et al. | 24/689 |
| 4,793,155 | A | * | 12/1988 | Law | 24/113 R |
| 4,959,890 | A | * | 10/1990 | Pazurek | 24/113 MP |
| 5,070,546 | A | | 12/1991 | Stazo | |
| 5,088,127 | A | | 2/1992 | Thornock | |
| D325,941 | S | | 5/1992 | Bertrand | |
| D356,205 | S | | 3/1995 | Amato | |
| D365,916 | S | | 1/1996 | Hutchinson | |
| D366,751 | S | | 2/1996 | Gravante | |

(Continued)

*Primary Examiner*—Robert J. Sandy
*Assistant Examiner*—Ruth C Rodriguez
(74) *Attorney, Agent, or Firm*—Stetina Brunda Garred & Brucker

(57) ABSTRACT

A removable hat accessory, having a display object and an attaching device. The display object has an opening extending axially and upwardly from a bottom thereof. The attaching device has a fastener for holding the attaching device to the display object, and a spring member for removably attaching the hat accessory to a button of a hat or a cap. To attach the hat accessory to the hat, the lower portion of the spring is slid under the hat button.

21 Claims, 3 Drawing Sheets

U.S. PATENT DOCUMENTS

| | | | | | |
|---|---|---|---|---|---|
| D370,333 | S | | 6/1996 | Lewis | |
| 5,542,157 | A | * | 8/1996 | Herman | 24/113 MP |
| 5,561,864 | A | | 10/1996 | DeMars | |
| D376,468 | S | | 12/1996 | Berman | |
| D391,389 | S | | 3/1998 | Ramirez, Jr. | |
| 5,734,991 | A | | 4/1998 | Schmid | |
| D397,839 | S | | 9/1998 | Lettieri | |
| D399,037 | S | | 10/1998 | Davis, III | |
| 5,903,927 | A | | 5/1999 | Wolfe | |
| D410,318 | S | | 6/1999 | Chen | |
| D410,690 | S | | 6/1999 | Pratt | |
| 6,026,658 | A | * | 2/2000 | Weller | 63/1.11 |
| 6,049,912 | A | | 4/2000 | Linehan | |
| 6,279,167 | B1 | | 8/2001 | Johnson | |
| D454,678 | S | | 3/2002 | Graves | |
| D475,322 | S | * | 6/2003 | Ouellette et al. | D11/222 |
| 2004/0226145 | A1 | * | 11/2004 | Ouellette et al. | 24/113 MP |

* cited by examiner

REMOVABLE HAT ACCESSORY

CROSS-REFERENCE TO RELATED APPLICATIONS

This invention is a continuation-in-part of an earlier filed Parent application Ser. No. 10/645,368, entitled "Removable Hat Accessory" filed Aug. 21, 2003, now U.S. Pat. No. 7,350, 724, the disclosure of which is expressly incorporated herein by reference.

STATEMENT RE: FEDERALLY SPONSORED RESEARCH/DEVELOPMENT

Not Applicable

BACKGROUND

The invention relates in general to hat accessories, and more particularly, to a hat accessory that can be removably attached to a button found on conventional hats/caps.

In order to make hats more visually appealing for various reasons such as displaying promotions and comedic effect, many hats, especially baseball-style caps, typically include a central button at its apex. The central button provides a convenient means of attaching various accessories to the hat.

Many products have been designed to attach accessories to the button on top of a hat or a cap. For instances, U.S. Pat. No. 5,530,970 issued to Knutson, discloses a display object attached to a spring. By rotation and pressing the spring against the hat button, one or more of the spring coils advances past the button and restores its original dimension underneath the button. As such, an interference fit between the button and the bottom coils of the spring secures the device to the hat.

Also, U.S. Pat. No. 5,070,546 issued to Stazo discloses a device with a thin-walled bottom member that includes a hole with slits or slots radially extending therefrom. The slits or slots allow the portion of the bottom member surrounding the hole to deform when pushing the button into the hole. Such deformation allows the button to advance past the bottom member, and then the bottom member returns to its original shape. Thus, interference between the bottom member and the button secures the device to the hat. Both the Knutson and Stazo patents disclose objects that can be removably attached to the button of a hat/cap due to interference between the button and the device itself. However, as both Knutson and Stazo require members that locally flex in order to achieve an interference fit, repeated attachment and removal of the device, that is, repeated flexure can eventually lead to failure of the devices. For instance, since the same coil spring of the Knutson device must cyclically flex during attachment and removal, repeatedly attaching and detaching of the device can cause the coils to permanently deform. Likewise, repeated attachment and detachment of the Stazo device can eventually fracture the portion of the bottom member surrounding the hole. In both instances, a secure interference fit between the respective device and the button is eliminated.

Therefore, there exists a substantially need in the art for a hat/cap accessory that can be easily and repeatedly attached to and removed from a button of the cap by more reliable attaching/detaching mechanism.

BRIEF SUMMARY

A removable hat accessory is provided. The hat accessory includes a display object and an attaching device. Preferably, the display object has an opening extending axially and upwardly from a bottom thereof. The attaching device includes a fastener for holding the attaching device to the display object, and a spring member for removably attaching the hat accessory to a button of a hat or a cap. In one embodiment, the fastener is in the form of a plastic ring. Preferably, the height of the plastic ring is no larger than the depth of the opening, such that a majority portion of the plastic ring can be embedded in the opening. Various fastening means can be used to fasten or attach the plastic ring to the display object. For example, a plurality of fins may be formed to project from a top rim of the plastic ring, and a plurality of slots may be formed on the inner sidewall of the display object within the opening. The projecting fins can thus rotate or press to engage with the mating slots. Thereby, the attaching device and the display object are detachably interlocked with each other. If a permanent attachment is preferred, glue or other adhesive can be used between the fastener and the display object.

As mentioned above, the attaching device further comprises a spring member for attaching the hat accessory to the button of the hat. In one embodiment, the spring member includes a flat upper spring ring for retaining the fastener therein and a lower spring ring having a proximal end connected to the upper spring ring. To retain the fastener within the upper spring ring, the fastener further includes a plurality of tabs radially projecting from a bottom rim of the plastic ring. The tabs can thus be press fitted within the upper spring ring. Preferably, the fastener further comprises a flange connected to the bottom ring of the plastic ring via the tabs. The flange extends between an inner perimeter and an outer perimeter of the upper spring ring. Therefore, when the attaching device is fastened to the display object, the upper spring ring is firmly sandwiched (i.e., captured) between the flange of the fastener and the bottom of the display object.

The upper spring ring and the lower spring are connected to each other by a joint spring member. Preferably, the lower spring is in the form of a two-leaf spring. The leaves are parallel to each other and operative to extend under the button of the hat through two opposing sides thereof. The distal ends of the leaves are preferably curved upwardly to avoid loose attachment. To attach the hat accessory to the hat, the leaves of the lower spring are positioned at two opposing sides of the button and sliding towards the button. To accommodate the button between the upper spring ring and the lower spring, the joint spring member is slightly bent to enlarge the space between the upper spring ring and the lower spring. When the button reaches the opening under the display object, the joint spring returns to its original position to allow the spring force to properly hold the button within the opening of the display object.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
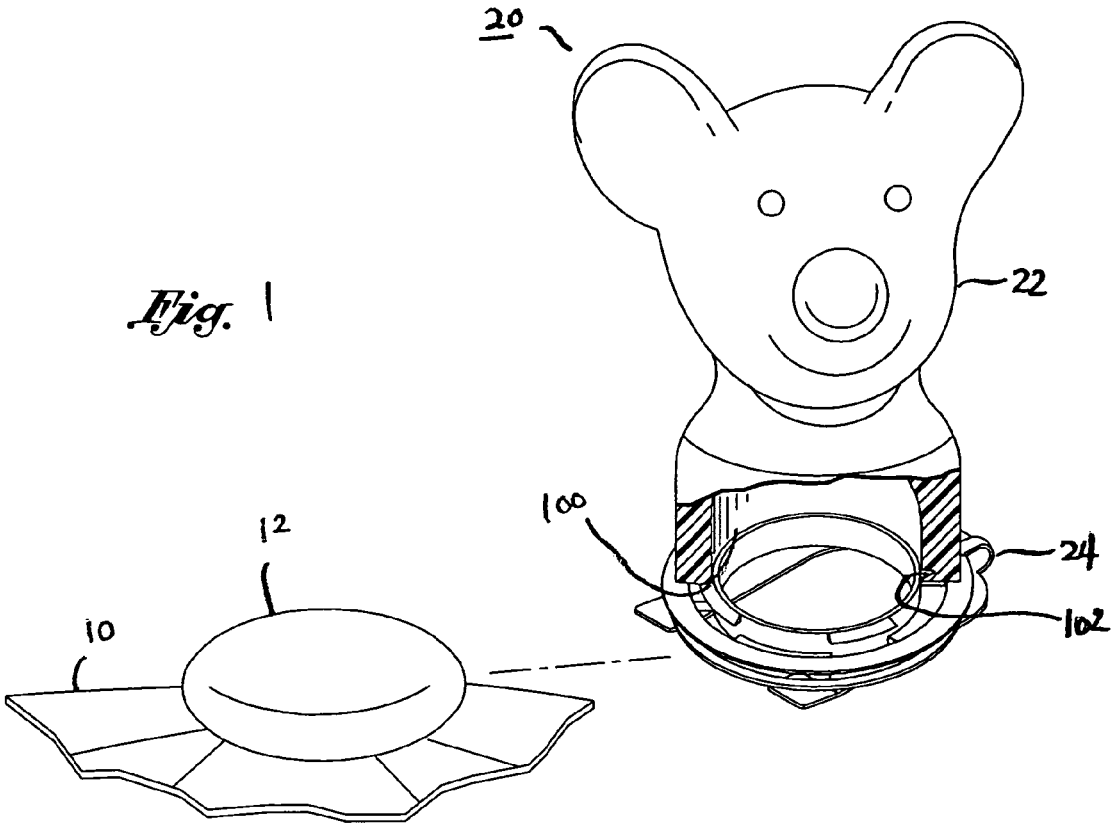
FIG. 1 shows a perspective view of a hat accessory and a hat button to which the hat accessory to be attached.

A hat accessory for removably attaching to a button of a hat is provided, and various views of an embodiment of the hat accessory have been illustrated in FIGS. 1 to 6. As shown in FIG. 1, the hat accessory 20 includes a display object 22 and an attaching device 24 for attaching the display object 22 to a button 12 of a hat 14. As shown in FIG. 1, the display object 22 has an opening 100 extending axially and inwardly from a bottom thereof for receiving the button 12 of the hat 10 therein when the hat accessory 20 is attached to the hat 10.

Figure 2:
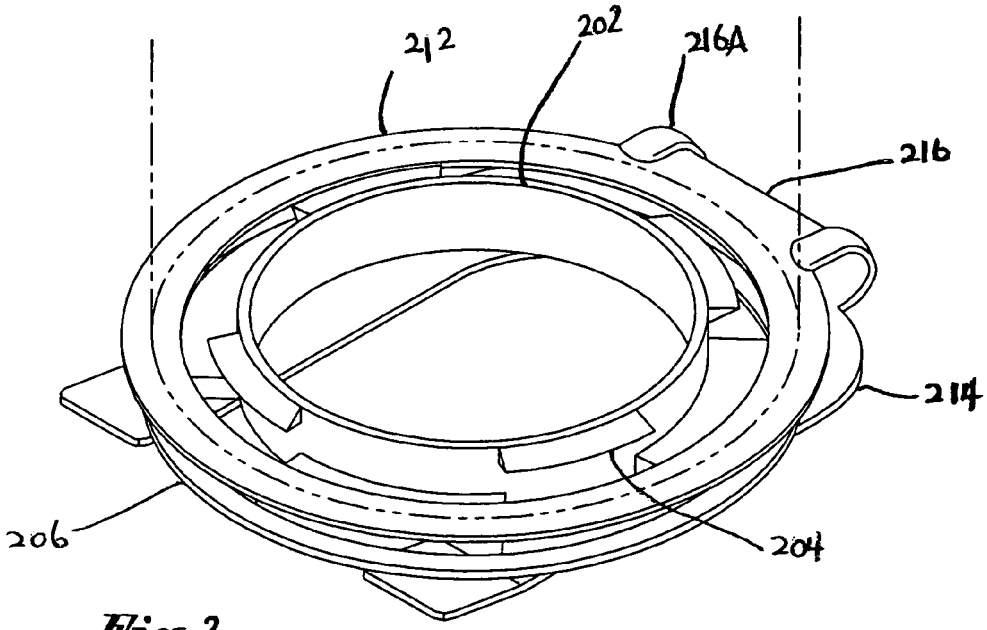
FIG. 2 shows a perspective view of the base of the hat accessory as shown in FIG. 1.
Figure 3:
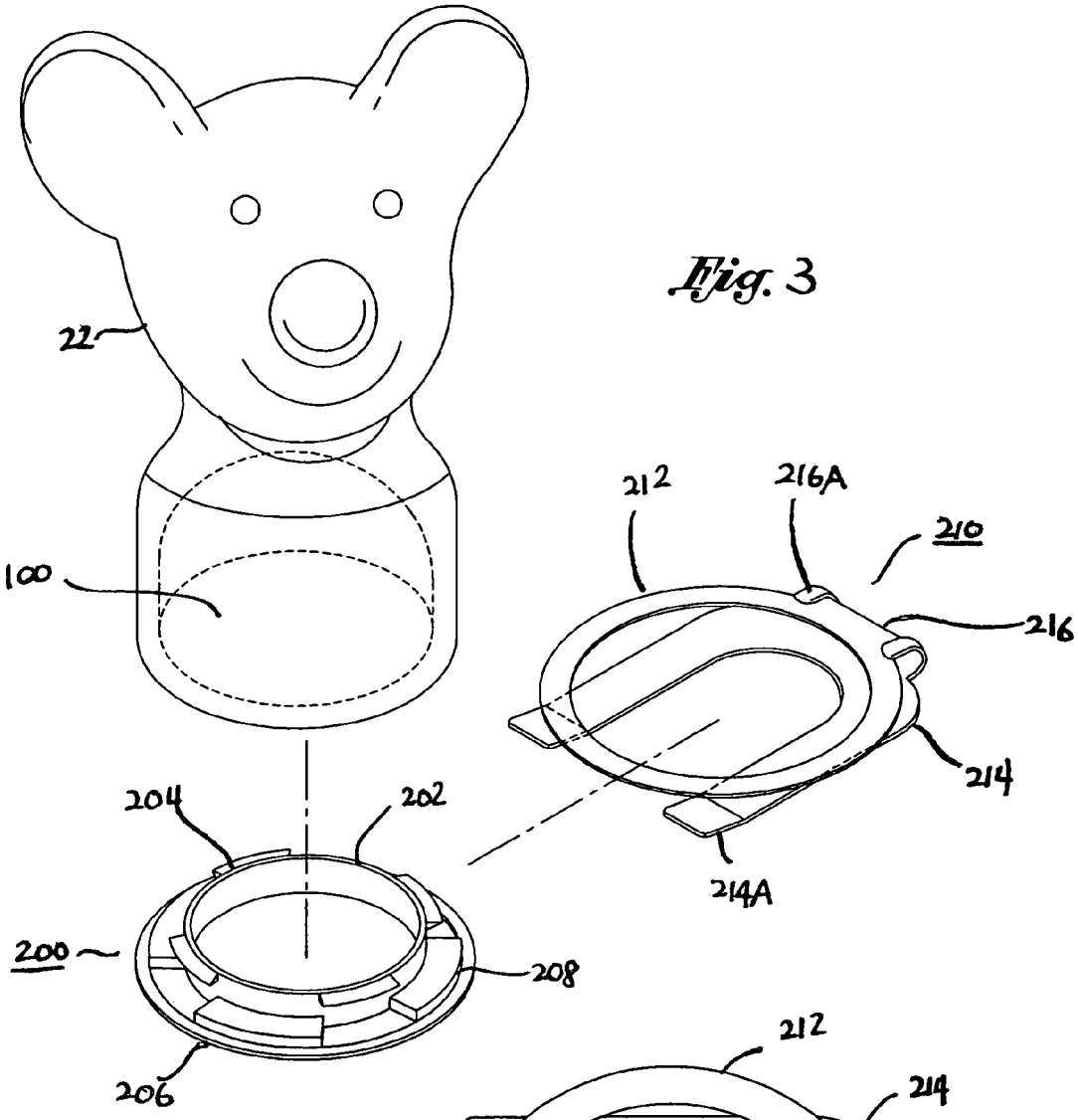
FIG. 3 shows an exploded view of the hat accessory as shown in FIG. 1.
Figure 5:
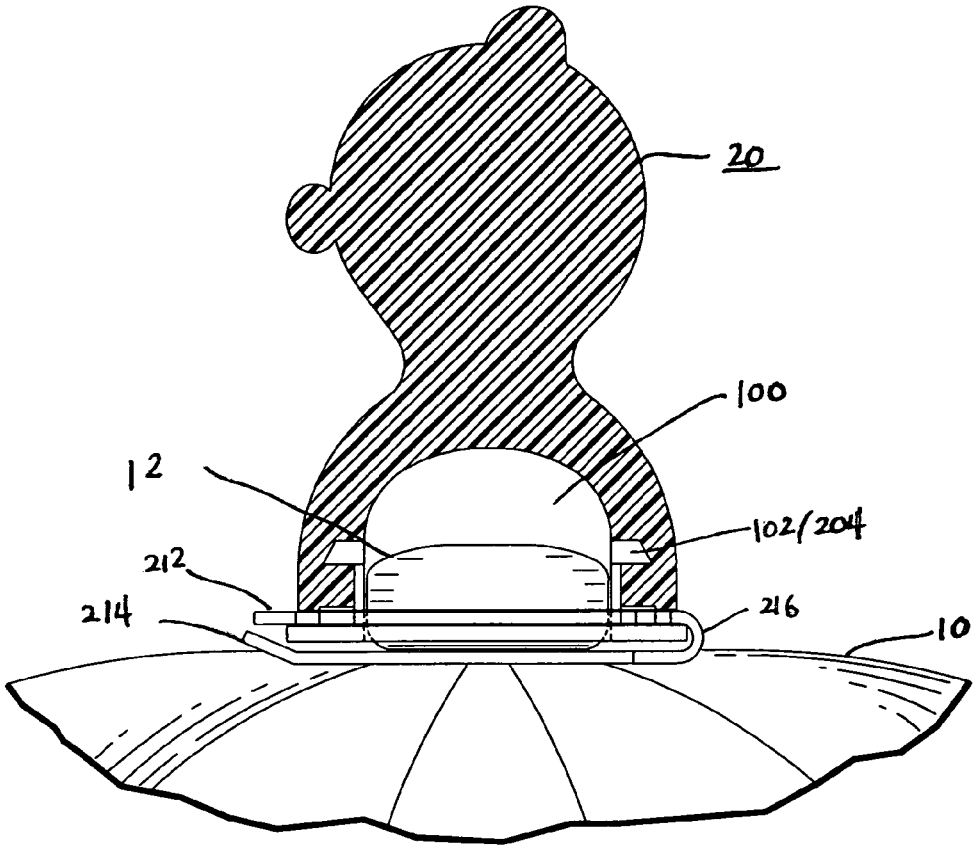
FIG. 5 shows a cross sectional view of the hat accessory attached to a hat.
Figure 6:
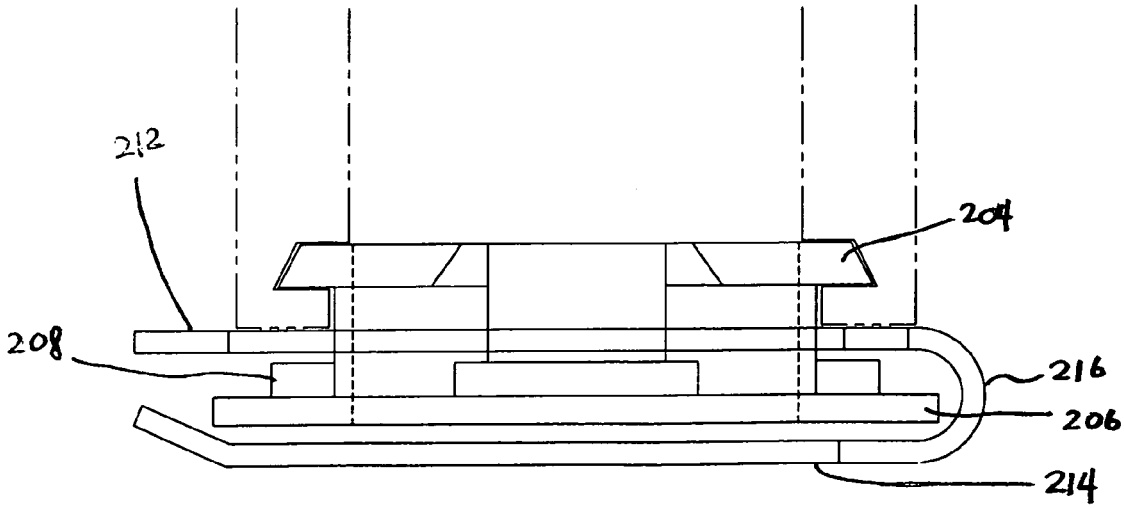
FIG. 6 shows a side view of the base of the hat accessory.

Referring to the perspective view of the attaching device 24 as shown in FIG. 2 and FIG. 3, the attaching device 24 includes a fastener 200 for permanent attachment to the display object 22 and a spring member 210 for releasably attaching to the button 12 of the hat 10. The fastener 200 is preferably in the form of a plastic ring 202 with a height no larger than the depth of the opening 100 in the display object 22. In addition, the perimeter of the plastic ring 202 is formed equal to or slightly smaller than the diameter of the opening 100, such that the fastener 200 can be positioned within/embedded within the opening 100. As shown in FIG. 3, the fastener 200 includes a plurality of fins 204 projecting radially from a top rim of the plastic ring 202. To attach the fastener 200 to the display object 22, a plurality of mating slots 102 may form on an inner sidewall within the opening 100 of the display object 22. The mating slots 102 are illustrated in FIG. 1 and the cross sectional as illustrated in FIG. 5. Preferably, the mating slots 102 may be configured to allow the fastener 200 to rotate to interlock the projection fins 204 with the mating slots 102. The projection fins 204 and the mating slots 102 can also be designed to press or snap fitting the fastener 200 with the display object 22 within the opening 100 thereof. It will be appreciated that the interlocking structures are not limited to the projecting fins 204 and the mating slots 102 only, any other interlocking or attaching structures operative to attach the fastener 200 within the opening 100 can also be used without exceeding the spirit and scope of the invention. In addition to the above attaching structures, the fastener 200 can also be permanently attached within the opening 100 by suitable adhesive/glue or bonding agent.

Referring to FIG. 3, the fastener 200 further includes a flange 206 around a bottom rim of the plastic ring 202. The flange 206 is connected to the bottom rim of the plastic ring 202 via a plurality of tabs 208. As shown, the projection fins 204 and the tabs 208 are alternately formed along a perimeter of the plastic ring 202. More specifically, each of the tabs 208 are preferably positioned under the space between the adjacent projection fins 204. Preferably, the width of each tab 208 along a radial direction of the plastic ring 202 is substantially the same as that of each projection fin 204.

As shown in FIGS. 2 and 3, the spring member 210 includes an upper spring member 212 and a lower spring member 214 joined with each other by a bent or folded spring member section 216. In this embodiment, the upper spring member 212 is in the form of a flat annular ring. It will be appreciated that the geometry of the upper spring member 212 as well as the plastic ring 202 may be altered when the shape of the opening 100 changes. Preferably, the upper spring member 212 has an outer perimeter larger than the flange 206 and an inner diameter smaller than the flange 206. The inner perimeter of the upper spring member 212 is sized to be about the same as the radial extent of the tabs 208. Therefore, the tabs 208 can be press fit within the upper spring member 212 to allow the plastic ring 202 to extend over the upper spring member 212 whereby the flange 206 contacts bottom surface of the upper spring member 212.

Figure 4:
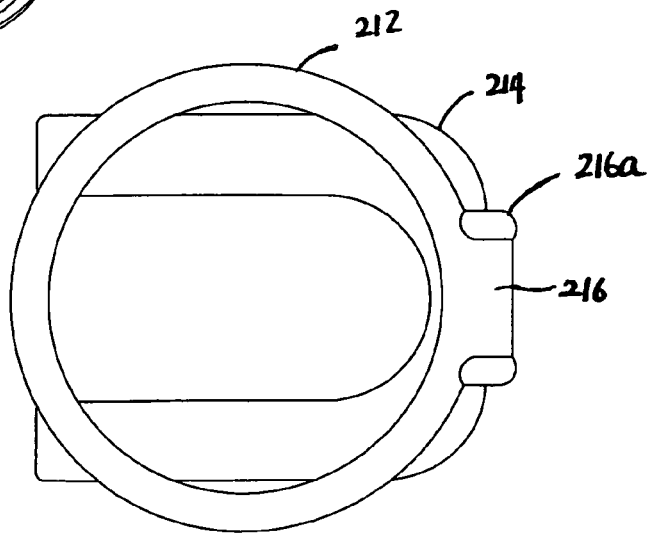
FIG. 4 shows a top view of a spring member of the base for attaching to a hat button.

The lower spring member 214 has a proximal end connected to the upper spring member 212 via the bent spring member section 216 and a distal end 214*a* curved upwardly, such that when the lower spring member 214 is slid underneath the button 12, the curved distal end 214*a* will prevent the hat accessory 20 from sliding away from the hat 10. As shown in FIGS. 3 and 4, in this embodiment, the lower spring member 214 has a U shape, that is, the lower spring member 214 includes two parallel leaves to slide along two opposing sides of the button 12. Further, as shown in FIGS. 3 and 4, the bent spring member section 216 includes two ridges 216*a* formed along two edges thereof. The formation of the ridges 216*a* increases the spring strength of the bent spring member section 216.

When the fastener 200 is attached to the display object 22 within the opening 100 thereof, the upper spring member 212 is sandwiched between the bottom of the display object 22 and the flange 206 of the fastener 200. To attach the display object 22 to the hat 10, the leaves of the lower spring member 214 are slid manually under the button 12 along two opposing sides thereof. Typically, the vertical distance between the upper spring member 212 and the lower spring member 214 is smaller than the height of the button 12. Therefore, the spring member section 216 flexes to open up the space between the upper spring member 212 and the lower spring member 214 allowing the button 12 to be received therein. When the lower spring member 214 is slid to a position that the button 12 is aligned with the opening 100 of the display object 22, the additional height of the button 12 is accommodated within the opening 100. Therefore, the joint spring member section 216 can return to its original unflexed position. As the distal end 214*a* of the lower spring member 214 is curved upwardly, plus that a portion of the button 12 is received within the opening 100, the hat accessory 20 is securely removably attached to the hat 10.

The above description is given by way of example, and not limitation. Given the above disclosure, one skilled in the art could devise variations that are within the scope and spirit of the invention disclosed herein, including various ways of attaching the attaching device to the display object. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A hat accessory, comprising:

a display object having a recessed bottom, and an attaching means, comprising:

a fastener fastenable to the display object within the recessed bottom portion; and a spring member being detachably coupled to a button of a hat, comprising:

an upper spring member for retaining the fastener therein;

a lower spring member; and a joint spring member flexibly connecting proximal end portions of the upper and lower spring members to enable the lower spring member to extend under the button of the hat and the upper spring member to extend over and about the button of the hat;

wherein the fastener includes a plastic ring encircled by the upper spring member and has a plurality of fins projecting from a top rim of the plastic ring and engage an inner surface of the recessed bottom.

2. The hat accessory of claim 1, wherein the lower spring member includes a two-leaf spring.

3. The hat accessory of claim 1, wherein the lower spring member has a distal end curved upwardly.

4. The hat accessory of claim 1, wherein the joint includes a folded spring member.

5. The hat accessory of claim 4, wherein the joint includes at least one ridges formed thereon for increasing bending strength.

6. A hat accessory, comprising:

a display object having a recessed bottom; and an attaching means, comprising:

a fastener fastenable to the display object within the recessed bottom portion; and a spring member for removably attaching the display object to a button of a hat, comprising:

an upper spring member for retaining the fastener therein, the upper spring member being operative to extend over the button of the hat;

a lower spring member operative to extend under the button of the hat; and a joint spring member connecting proximal ends of the upper and lower spring members;

wherein the fastener includes a plastic ring encircled by the upper spring member and has a plurality of fins projecting from a top rim of the plastic ring and the display object has a plurality of slots formed on an inner sidewall at the recessed bottom for interlocking the projecting fins.

7. The hat accessory of claim 6, wherein the projecting fins are operative to rotate within the recessed bottom to engage with the mating slots.

8. The hat accessory of claim 6, wherein the projecting fins are pressed to fit with the mating slots.

9. A hat accessory, comprising:

a display object having a recessed bottom; and an attaching means, comprising:

a fastener fastenable to the display object within the recessed bottom portion; and a spring member for removably attaching the display object to a button of a hat, comprising:

an upper spring member for retaining the fastener therein, the upper spring member being operative to extend over the button of the hat;

a lower spring member operative to extend under the button of the hat; and a joint spring member connecting proximal ends of the upper and lower spring members;

wherein the fastener includes a plastic ring encircled by the upper spring member and, wherein the fastener further comprises a flange connected to a bottom rim of the plastic ring by a plurality of tabs.

10. The hat accessory of claim 9, wherein the tabs are arranged under the spaces between the adjacent fins.

11. The hat accessory of claim 9, wherein the extended rim has an exterior perimeter slightly smaller than that of the upper spring member and larger than an interior perimeter of the upper spring member.

12. The hat accessory of claim 9, wherein the tabs are press fitted within the upper spring member.

13. A hat accessory, comprising:

a display object having a recessed bottom; and an attaching means, comprising:

a fastener fastenable to the display object within the recessed bottom portion; and a spring member for removably attaching the display object to a button of a hat, comprising:

an upper spring member for retaining the fastener therein, the upper spring member being operative to extend over the button of the hat;

a lower spring member operative to extend under the button of the hat; and a joint spring member connecting proximal ends of the upper and lower spring members;

wherein the recessed bottom of the display object is operative to receive the button of hat therein.

14. An attaching means for holding a display object to a button of a hat, wherein the display object has an opening extending axially and inwardly from a bottom surface thereof, the attaching means comprising:

a fastener to be attached to the display object; and a spring member, having an upper spring ring for fitting the fastener therein, a lower spring having two parallel leaves for sliding under the button through two opposing sides thereof, and a joint spring member flexibly connecting proximal end portions of the upper spring ring and the lower spring, wherein:

when the lower spring is sliding under the button, the joint spring member is operative to bend to enlarge a space between the upper spring ring and the lower spring, such that the upper spring ring extends over the button to enable the button to enter the space; and the joint spring member restores to an unbent state when the button is received within the opening of the display object, such that the lower spring extends under the button and the upper spring ring extends about the button.

15. The attaching device of claim 14, wherein the fastener includes a plastic ring.

16. The attaching device of claim 15, wherein the plastic ring has a height no larger than a depth of the opening.

17. The attaching device of claim 15, wherein the fastener further includes a flange extended from a bottom rim of the plastic ring.

18. The attaching device of claim 17, wherein the flange is connected to the bottom rim of the plastic ring by a plurality of tabs.

19. The attaching device of claim 18, wherein the plurality of tabs are so designed to press fit within the upper spring member.

20. An attaching means for holding a display object to a button of a hat, wherein the display object has an opening extending axially and inwardly from a bottom surface thereof, the attaching means comprising:

a fastener to be attached to the display object, the fastener including a plastic ring having a plurality of fins projecting from a top rim thereof, and the display object including a plurality of slots formed on an inner sidewall within the opening for mating the projecting fins; and a spring member, having an upper spring ring for fitting the fastener therein, a lower spring having two parallel leaves for sliding under the button through two opposing sides thereof, and a joint spring member connecting proximal ends of the upper and the lower spring members, wherein:

when the lower spring is sliding under the button, the joint spring member is operative to bend to enlarge a space between the upper spring ring and the lower spring, such that the button is allowed to enter the space; and the joint spring member restores to an unbent state when the button is received within the opening of the display object.

21. An attaching means for holding a display object to a button of a hat, wherein the display object has an opening extending axially and inwardly from a bottom surface thereof, the attaching means comprising:

a fastener to be attached to the display object, wherein the fastener includes a plastic ring wherein the plastic ring is attached within the opening by adhesive; and a spring member, having an upper spring ring for fitting the fastener therein, a lower spring having two parallel leaves for sliding under the button through two opposing sides thereof, and a joint spring member connecting proximal ends of the upper and the lower spring members, wherein:

when the lower spring is sliding under the button, the joint spring member is operative to bend to enlarge a space between the upper spring ring and the lower spring, such that the button is allowed to enter the space; and the joint spring member restores to an unbent state when the button is received within the opening of the display object.

* * * * *